United States Patent [19]

Smith

[11] Patent Number: 4,638,821

[45] Date of Patent: Jan. 27, 1987

[54] METHOD AND APPARATUS FOR ISOLATION OF HAIR FROM TREATMENT MATERIALS

[75] Inventor: Donald R. Smith, Rock Hill, S.C.

[73] Assignee: Michael H. King, Tega Cay, S.C. ; a part interest

[21] Appl. No.: 689,463

[22] Filed: Jan. 7, 1985

[51] Int. Cl.[4] ..... A45D 7/00

[52] U.S. Cl. ..... 132/7; 132/39

[58] Field of Search ..... 132/39, 40, 42, 41, 132/7

[56] References Cited

U.S. PATENT DOCUMENTS

| | | | |
|---|---|---|---|
| 1,948,467 | 2/1934 | Decker | 132/33 G |
| 2,210,897 | 8/1940 | Caldora | 132/33 G |
| 2,564,558 | 8/1951 | Berman et al. | 132/41 R |
| 2,754,831 | 7/1956 | Polykranas | 132/39 |
| 3,943,946 | 3/1976 | Gallegos | 132/39 |
| 4,344,447 | 8/1982 | Morrow | 132/42 R |

*Primary Examiner*—Gregory E. McNeill

*Attorney, Agent, or Firm*—Clifton Ted Hunt

[57] ABSTRACT

An apparatus and method for protecting a portion of hair from hair treatment chemicals. The apparatus comprises a protective socket and a core receivable within the socket. The method comprises wrapping the portion of hair to be protected on the core and placing the core with the protected portion of hair within the socket and with the unprotected portion of hair extending outwardly from the socket. A conditioner is applied to the hair at the socket to prevent entry of the hair treatment chemicals into the socket.

7 Claims, 6 Drawing Figures

METHOD AND APPARATUS FOR ISOLATION OF HAIR FROM TREATMENT MATERIALS

BACKGROUND OF THE INVENTION

This invention relates to an apparatus and method for isolating certain parts of a person's hair from other parts of that person's hair to be treated with hair waving, straightening, bleaching, or dyeing material.

Certain hair treatment procedures require the protective shielding or isolation of specific portions of the hair from the rest of a person's hair. For example, in a conventional hair curling process, the hair is wound or rolled onto winding rods or hair curlers and a cold waving solution is then applied to the hair after it has been wound on the curlers. The solution is allowed to set and the hair is then unwound from the curlers to complete the process. After several months of repeated applications of such cold waving solutions, the hair can become brittle and frizzy. It is, therefore, desirable to isolate previously treated hair when curling other portions of the hair. The separation of the previously treated hair sections from those which are to be treated has heretofore been a tedious and time consuming operation which is accomplished by placing impermeable sheets of material about the hair to be protected by isolation from the hair to be treated.

Hair straightening, hair frosting and reverse hair frosting are other hair treatment procedures in which it is important to protect certain portions of the hair from treatment materials used on other portions of the hair.

U.S. Pat. No. 3,943,946 issued Mar. 16, 1976 to Gallegos and U.S. Pat. No. 3,960,156 issued June 1, 1976 to Thompson each disclose the use of an impermeable sheet of plastic or the like for protecting certain sections of hair while chemically treating other portions of the hair. The encasement of the portions of hair to be protected within the impermeable sheets requires a lot of time and talent, which is expensive. The effectiveness of the prior art apparatus and methods for protecting certain portions of the hair depends in large amount on the skill of the stylist and are often ineffective to the detriment of the hair and it's appearance.

SUMMARY OF THE INVENTION

According to the present invention, an apparatus and method are provided which are operative to quickly and effectively isolate certain hair portions from the rest of the hair to thereby enable treatment of other hair portions without affecting the protected portions.

The apparatus includes a core on which the hair to be protected is wound and a substantially impermeable socket within which the core and hair wound on it is positioned to protect the hair on the core from chemicals applied to the rest of the hair. The socket is made in two portions hinged together to close about the core after the desired amount of hair has been wound on the core. The core comprises a circular rod with angularly shaped end pieces formed integral with the rod. The end pieces may be hexagonal or any desired irregular configuration to conform with correspondingly shaped recesses within the socket so that the core and socket will be fixed against relative motion when assembled and thereby prevent the hair to be isolated from unwinding from the core.

In use, a plurality of cores, each measuring about two and one-half (2½) inches (6.35 cm) are individually wound with the portions of hair to be protected and each core is placed within it's socket; the sockets are closed about the core and hair wound thereon; a conditioner is applied to the edges of the opening in the socket which receives the hair to prevent the treating chemical from entering the sockets and the remainder of the hair to be treated is wound on the exterior of the socket. The socket is then attached to the person's hair with an elastic band in the usual manner.

The method of the present invention is quickly and easily performed with a minimum of skill and is very effective in isolating selected hair portions from the chemical action on the remainder of the hair to be treated.

Other objects of the invention will become apparent to those skilled in the art when considered in light of the following description, taken in connection with the accompanying drawings.

DETAILED DESCRIPTION OF THE INVENTION

Figure 6:
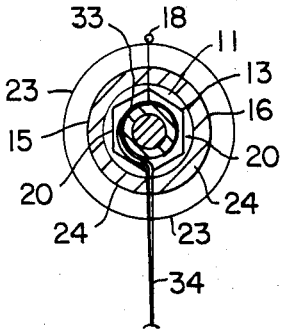
FIG. 6 is a sectional view through the socket and core after the portion of hair to be protected has been wound on the core and the socket sealed about the core.

Referring more specifically to the drawings, the apparatus of this invention comprises a core broadly indicated at 10 and including a circular rod-like body portion 11 and end pieces 12 and 13 of enlarged diameter and of hexagonal or other desired angular configuration. A hollow socket is broadly indicated at 14 and includes two equally dimensioned and shaped portions 15 and 16 connected by hinges 17 and 18 in the embodiment of FIGS. 1, 2 and 6. Each portion 15 and 16 of the hollow socket 14 has a semi-circular chamber 20 extending axially of the socket and of larger inside diameter than the outside diameter of the body portion 11 of the core 10 to accomodate the portion of hair wound on the core to be isolated. For example, the body of the core may be about 5/32 of an inch (0.4 cm) in diameter and the diameter of the chamber 20 may be about 17/32 of an inch (1.35 cm).

Each chamber 20 communicates at its ends with an enlarged recess 21 to concide with one half of the diameter of the hexagonally shaped end pieces 12 and 13 when assembled about the core 10. The ends 22 and 23 of each portion 15 and 16 of socket 14 are enlarged relative to the housing 24 defining the semi-circular cavities 20 to facilitate manipulation of the socket as the portion of the hair to be exposed for treatment is wound around the exterior of the closed socket. Recessed walls 25 (FIG. 1) define a narrow slot 26 (FIG. 4) through which extends the portion of the hair to be treated.

Figure 1:
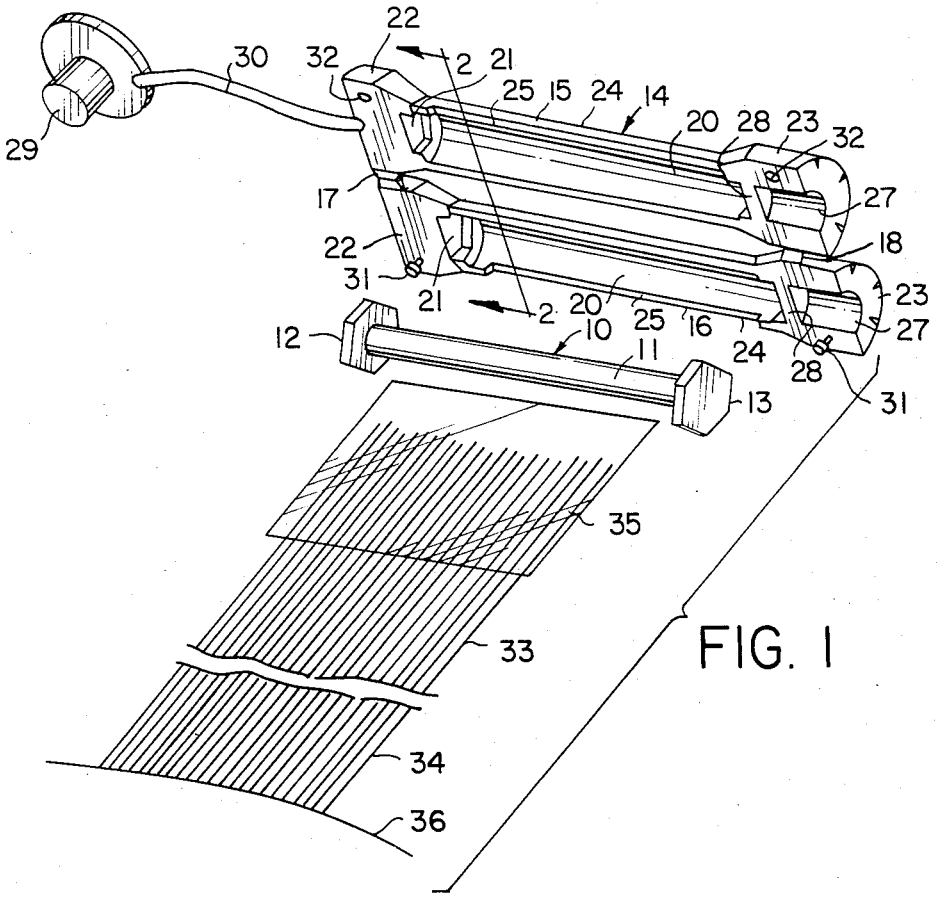
FIG. 1 is an exploded perspective view of the core and socket illustrating the wrapping of selected portions of hair on the core and the subsequent sealing of the wrapped hair and core within the socket.
Figure 2:
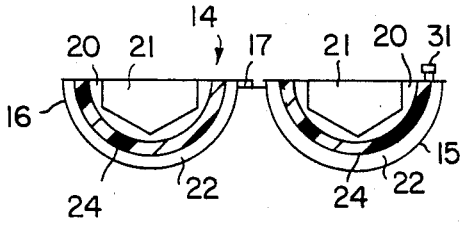
FIG. 2 is a sectional view taken substantially along the Line 2—2 in FIG. 1.
Figure 4:
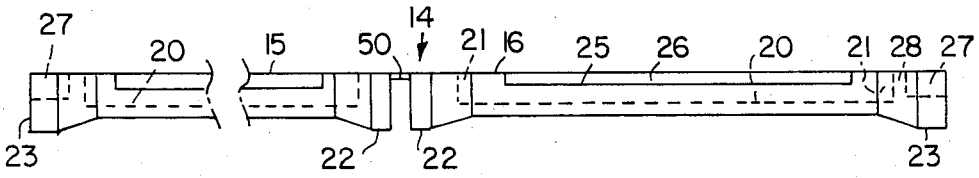
FIG. 4 is an elevation of a modified form of the socket, with parts broken away.
Figure 5:
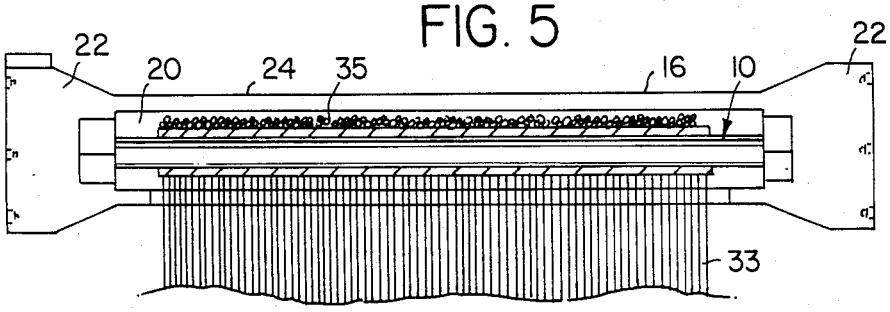
FIG. 5 is a plan view, partially in section, showing a core mounted in one portion of the socket with hair wound on the core and extending therefrom.

The ends 23 of the socket 14 each include a semi-circular cavity 27 communicating with the atmosphere at the end of the socket and separated from the semi-circular chamber 20 by a wall 28 (FIGS. 1 and 4). A plug 29 is shaped to snugly fit within the circular cavity 27 when the socket portions 15 and 16 are closed about the core 10. The plug 29 is connected by an elastic cord 30 to the end 22 of socket portion 15 and the cord 30 extends over that portion of the hair to be treated and rolled on the socket 14 to hold the socket on the person's head after the plug 29 is fitted in the cavity 27, The portions 15 and 16 of socket 14 are releasably held together in closed position about the core 10 by pins 31 in the ends 22 and 23 of the portion 16. The ends 22 and 23 of socket portion 15 have holes 32 to frictionally receive the pins 31 and hold the portions 15 and 16 together when desired.

In use, a selected portion 33 of a person's hair which is desired to be protected from another portion 34 of hair is wound on the body portion 11 of the core 10. It is conventional practice and a preferred step in the wrapping of the protected hair portion 33 on the core 10 to use an end paper 35 to facilitate handling and care of the hair. The end paper is soft and absorbent and the wettened ends of the hair portion 33 to be protected cling to the end paper for stabilization and to keep them from becoming frizzy while confined within the socket during treatment of the remainder of the hair. The use of end paper is conventional and forms no part of this invention, but its use as described is helpful in stabilizing the hair portions 33 isolated from treatment. The end paper 35 is not critical to the invention and need not be used. It plays no part in protecting the hair portion 33 from the chemicals used to treat the remaining hair portion 34 extending from the scalp 36 in FIG. 1.

After the section of hair 33 to be protected has been wound on the core 10 with its end paper 35, the end pieces 12 and 13 of the core are registered with the openings or recesses 21 at the ends of the chamber 20 in socket portion 16 and socket portion 15 is then rotated about hinges 17 and 18 to enclose the core 10 within the socket 14. The pins 31 are seated in their respective holes 32 to hold the socket in closed position with the portion of hair 34 to be treated extending from the socket through the slot 26. A conditioner which resists the chemical with which the hair section 34 is to be treated is applied to the recessed walls 25 defining the slot 26 to prevent entry of the treating chemical into the socket.

The section of hair 34 to be treated is then rolled on the housing 24 of socket 14 by manipulation of its enlarged ends 22 and 23 in the customary manner of rolling hair. The cord 30 and its plug 29 are then drawn over the hair and seated in the cavity 27 to hold the socket on the person's head in a known manner as shown, for example, in U.S. Pat. No. 3,960,156. The hair portion 34 is then treated with the desired chemical for curling or otherwise conditioning it while the isolated hair portion 33 remains in the socket 14. After treatment of the hair portion 34 is completed, that portion of the hair is unwound from the socket, the socket is opened, the core 10 and the isolated hair portion 33 is removed from the socket, and the hair portion 33 is unwound from the core 10 to complate the process.

Figure 3:
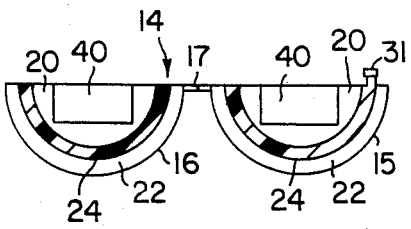
FIG. 3 is a sectional view similar to FIG. 2 but illustrating a modified form of the invention.

A modified form of the invention is illustrated in FIG. 3 wherein parts like those previously described in connection with the embodiment of FIG. 1 bear the same reference numbers and a further description of those parts is deemed unnecessary to an understanding of the modified invention. The modification of FIG. 3 consists entirely of a different configuration for the angularly shaped recesses 21 in FIG. 1. The recess 21 in FIG. 1 is made to conform to the configuration of half of the configuration of the hexagonal end pieces 12 and 13 on the core 10.

In FIG. 3 an angularly shaped recess is indicated at 40 as being of rectangular configuration instead of the hexagonal configuration of the recesse 21. The rectangular configuration of the recess 40 would be used to conform to a rectangularly shaped end piece, not shown, on the ends of the core 10. The end pieces on the core 10 can be of any desired configuration to prevent relative movement between the core and the socket.

A hexagonal configuration for the end pieces and the mating recesses in the socket is preferred because the hexagonal configuration enables a stylist to precisely define the amount of hair to be wrapped around and retained on the core after the core is positioned in the socket. Use of an end piece with a rectangular configuration mating with a rectangular recess as indicated at 40 in FIG. 3 would not enable the precision obtainable with the hexagonal end pieces and recesses of FIG. 1 because the core would be turned as much as one-half ($\frac{1}{2}$) revolution in either direction to seat a rectangular end piece in the rectangular recess 40 of FIG. 3. That may not be objectionable in some cases and it is within the spirit of the invention to provide end pieces and mating recesses in the socket of any desired configuration.

Another modification of the invention is illustrated in FIG. 4 wherein parts like those previously described in connection with the embodiment of FIG. 1 bear the same reference numbers and a further description of those parts is deemed unnecessary to an understanding of the modified invention. In FIG. 4, the socket portions 15 and 16 are connected in end to end relation by a single hinge 50, replacing the side mounted hinges 17, 18 of FIG. 1. Use of the modified socket of FIG. 4 is similar to use of the socket of FIG. 1 except that after the core with its isolated portion of hair wound thereon is positioned in, for example, socket portion 16, the other socket portion 15 is moved end-wise about hinge 50 to overlie socket portion 16 and enclose the core and isolated hair portion 33.

Although specific terms have been employed in the specification, they are used in a descriptive and generic sense only and not for purposes of limitation.

I claim:

1. Apparatus for protecting a portion of hair from hair treatment chemicals applied to an unprotected portion of hair on a person's head, said apparatus comprising a protective socket and a core, said socket including two hinged portions each having a semi-circular chamber, said core including a rod-like body portion on which the protected portion of hair may be wound, said hinged portions of the socket being movable into juxtaposition about the core with the protected portion of hair wound thereon, the socket having a slot defined by spaced apart walls through which extends an unprotected portion of hair to be chemically treated, and a conditioner for application to the hair at the slot to prevent entry of the hair treating chemicals into the socket; whereby the hair wound on the core within the socket is protected from hair treatment chemicals applied to an unprotected portion of hair.

2. An apparatus according to claim 1 which includes means for limiting relative movement of the socket and core in assembled relation.

3. Apparatus according to claim 1 which includes means for holding the assembled socket and core on the head.

4. Apparatus according to claim 2 wherein said means for limiting relative movement between the socket and the core comprises angularly shaped end pieces on the core and correspondingly shaped recesses in the socket.

5. A method of protecting a portion of hair from hair treatment chemicals applied to an unprotected portion of hair on a person's head, said method comprising the steps of:

(a) providing a core, (b) wrapping a portion of hair to be protected on the core, (c) providing a protective socket extendable about the core with the protected portion of hair wound thereon, (d) placing the core and the said protected portion of hair within the socket, (e) closing the socket about the core and the protected portion of hair thereon with an unprotected portion of hair extending outwardly from the socket, (f) releasably locking the socket to prevent relative movement between the core and socket and thereby retain the said protected portion of hair on the core within the socket, (g) applying a conditioner to the unprotected hair extending from the socket to prevent entry of the hair treatment chemicals into the socket, and (h) rolling an unprotected portion of hair around the socket.

6. A method according to claim 5 wherein hair treatment chemicals are applied to the unprotected portion of hair after it is wound around the socket.

7. A method according to claim 5 wherein steps (a) through (h) are repeated and hair treatment chemicals are applied to the unprotected portion of hair until all of the unprotected hair on a person's head is chemically treated.

* * * * *